US007311051B2

(12) United States Patent
Ninomiya et al.

(10) Patent No.: US 7,311,051 B2
(45) Date of Patent: Dec. 25, 2007

(54) SEWING MACHINE PROVIDED WITH INDICATION DEVICE

(75) Inventors: Masashi Ninomiya, Hachioji (JP); Tsutomu Takagi, Hachioji (JP); Koshiro Omiya, Hachioji (JP); Takehiro Kodama, Hachioji (JP)

(73) Assignee: Janome Sewing Machine Co., Ltd., Tokyo (JP)

( * ) Notice: Subject to any disclaimer, the term of this patent is extended or adjusted under 35 U.S.C. 154(b) by 0 days.

(21) Appl. No.: 11/417,081

(22) Filed: May 3, 2006

(65) Prior Publication Data

US 2006/0278145 A1 Dec. 14, 2006

(30) Foreign Application Priority Data

Jun. 14, 2005 (JP) ..... 2005-173352

(51) Int. Cl.
*D05B 19/02* (2006.01)
*D05B 73/02* (2006.01)

(52) U.S. Cl. ..... 112/2; 112/444

(58) Field of Classification Search ..... 112/470.12, 112/470.13, 457, 217.1, 258, 259; 248/205.1, 248/274.1, 917–923
See application file for complete search history.

(56) References Cited

U.S. PATENT DOCUMENTS 4,323,023 A * 4/1982 Beckerman et al. ..... 112/454
4,329,933 A * 5/1982 Beckerman et al. ..... 112/457
4,335,667 A * 6/1982 Beckerman et al. ..... 112/445
4,512,271 A * 4/1985 Herdeg et al. ..... 112/445
4,966,089 A * 10/1990 Hanyu et al. ..... 112/444
6,925,946 B1 * 8/2005 Kang ..... 112/102.5

FOREIGN PATENT DOCUMENTS

JP 06031085 A * 2/1994

* cited by examiner

*Primary Examiner*—Ismael Izaguirre
(74) *Attorney, Agent, or Firm*—Nields & Lemack

(57) ABSTRACT

Sewing machine provided with an indication device including a display that is so large that the lower leftward portion protrudes into the stitch working area of the machine. The display may be moved up and down by of a switch and may be moved up until the lower end side of the display aligns with the lower end side of the machine arm and may be stopped at an upper optional position. At the lowest position, the upper end side of display has the upper side located in alignment with the top side of machine body and has the front side plane planar with the front side of the arm and has the lateral end side planar with the lateral end side of the machine body. The display has no part protruding from the machine body at the lowest position, and is thus placed compactly in the machine frame of machine body.

6 Claims, 5 Drawing Sheets

SEWING MACHINE PROVIDED WITH INDICATION DEVICE

BACKGROUND OF THE INVENTION

Field of the Invention and Related Art Statement

The present invention relates to a sewing machine and more particularly relates to a sewing machine provided with an indication device.

With development of the electronic technology in the recent years, there have been prevailed many sorts of sewing machines having many functions including an indication device which is provided with a liquid crystal display and the like for indicating the contents of information for controlling the operation of sewing machine.

Generally the indication device is arranged on the arm or standard of the sewing machine because the sewing machine has no other space for proper arrangement of the indication device.

However, the space of the arm or standard is limited. Further it is actually required to provide an operating part including operating switches and the like in addition to the display. On the other hand, with increase of functions and enlargement of the display in the recent years, it is generally desired to enlarge the display in connection with the sewing machine. In order to actually enlarge the display, it is required to enlarge the area of the machine arm or standard, eventually to enlarge the sewing machine. Thus it is very difficult to employ a large sized display in connection with the sewing machine.

It is, therefore, an object of the invention to solve such conventional technical problems.

SUMMARY OF THE INVENTION

For attaining the object of the invention, a sewing machine has a machine body composed at least of a bed, a standard standing up from the bed, an arm extending from the standard substantially in parallel with the bed, the sewing machine comprising an indication device including a display arranged on the machine body, a means for moving the display relative to the machine body, the display being movable into a retreat area defined at least by a top side, a bottom side and a lateral end side of the machine body.

Further it is preferable that the display may be moved to a position for providing a maximum stitch working space where the display will not extend into the space between the upper end side of the bed and lower end side of the arm.

With the structure as defined by the invention, a large sized display may be moved into the retreat area of machine frame and held there compactly. Further the display may be moved into a position where the display is actually used, the space between the upper end side of the bed and lower end side of the arm may be fully used for stitch working operations without being interfered by the display.

Thus according to the invention, a sewing machine having an indication device including a large sized display may be realized.

DETAILED DESCRIPTION OF THE PREFERRED EMBODIMENTS

The invention will be described in reference to the attached drawings.

Figure 1:
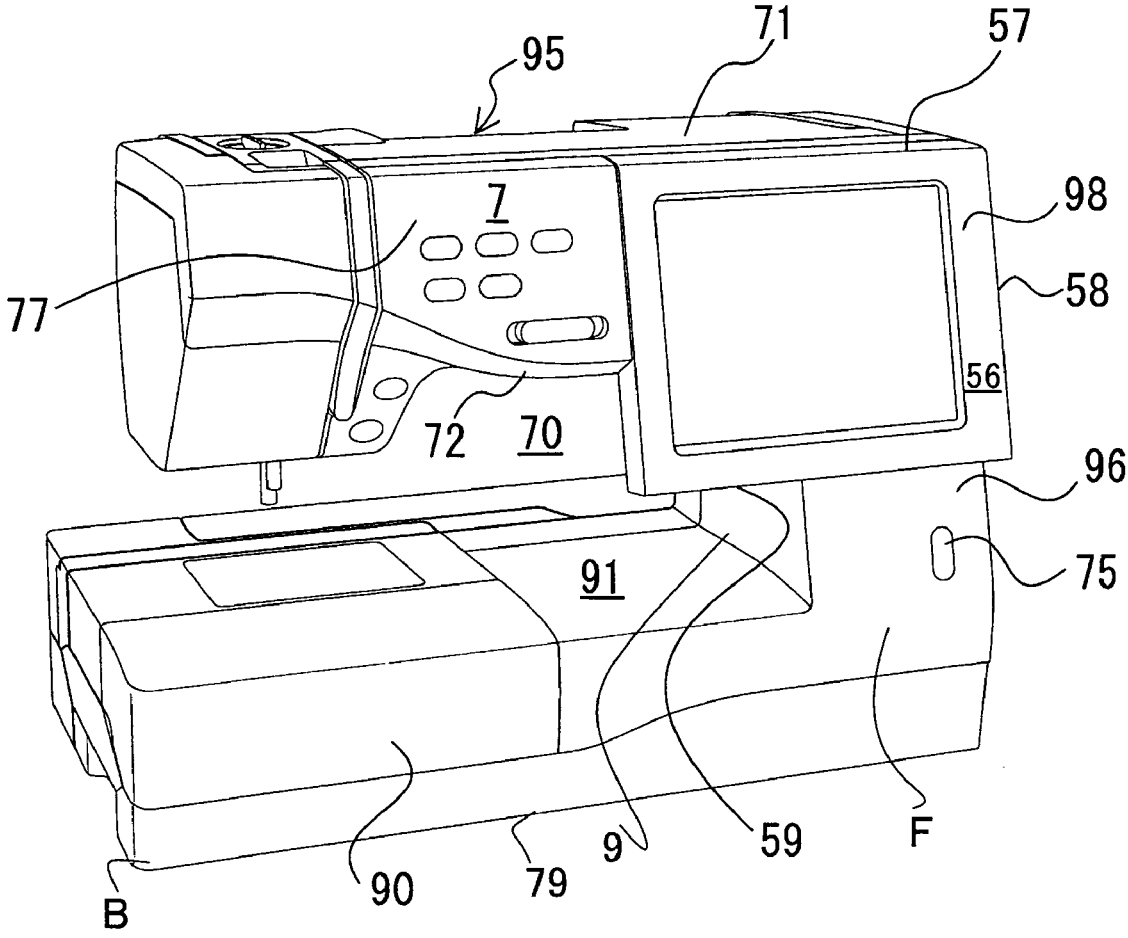
FIG. 1 is a perspective view of a sewing machine provided with the invention shown as one embodiment of the invention, in which a display is in a retreated position.

In FIG. 1, a sewing machine has a machine body B which s substantially composed of a bed 90, a standard 96 standing up from the bed 90 and an arm 95 extending laterally from the standard 96 above the bed 90 substantially in parallel with the bed 90.

Figure 2:
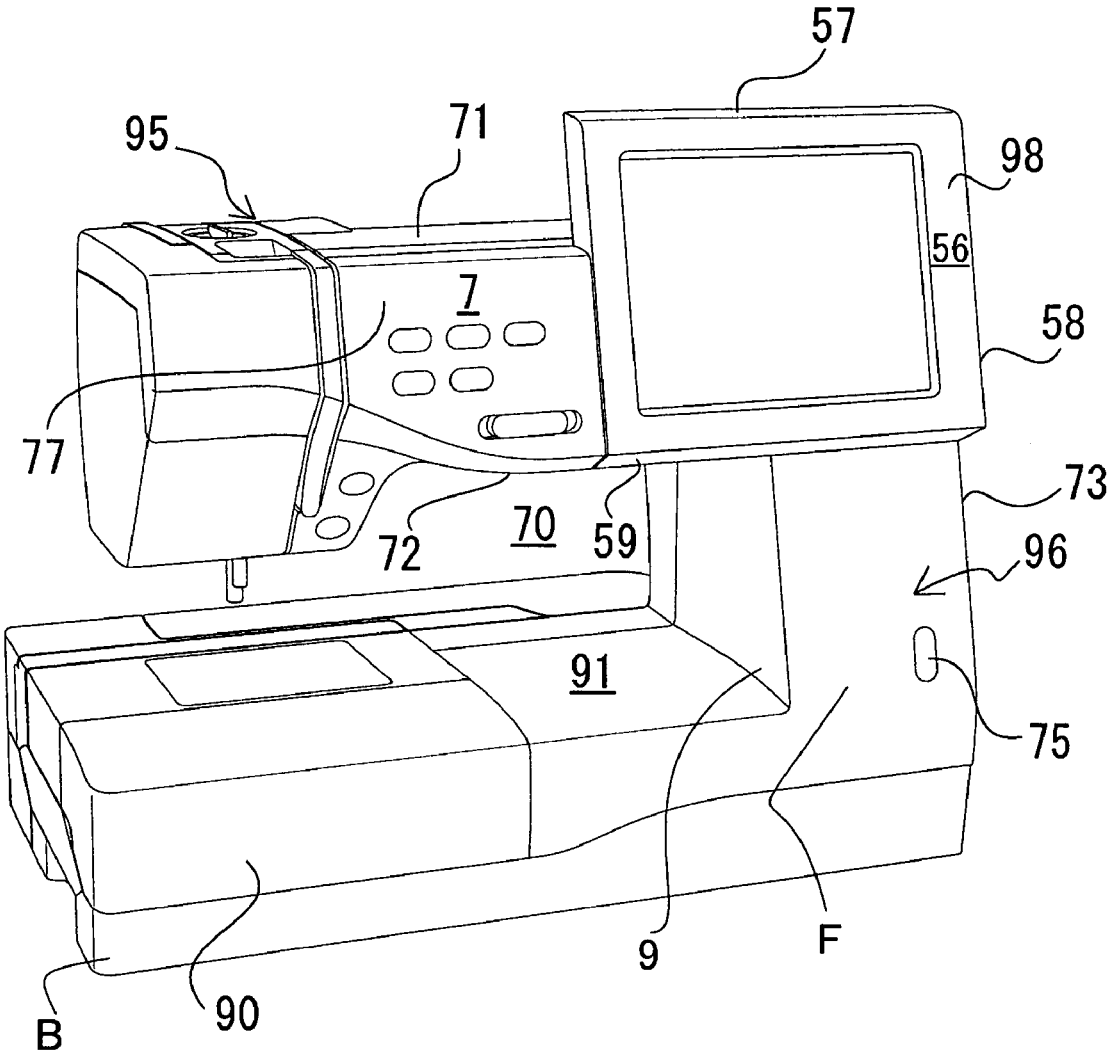
FIG. 2 is a perspective view of the sewing machine provided with the invention in which the display is moved to a position where the display is actually used.
Figure 3:
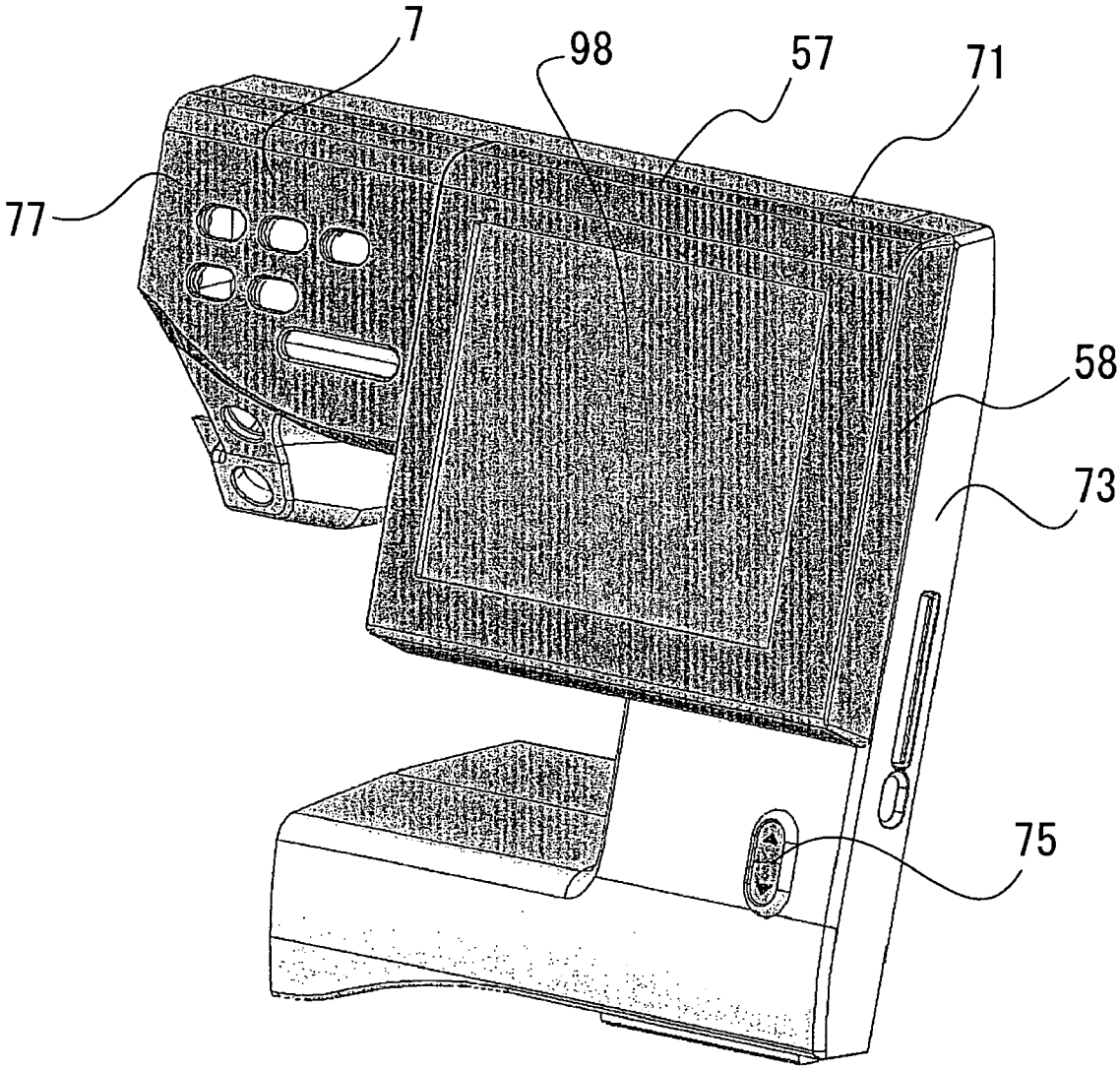
FIG. 3 is a perspective view of the essential part of sewing machine shown as being enlarged.

In view of the front side F of the machine body, that is, in the front side view of the machine body, a machine frame may be defined as enclosed by the outlines depicted with the top side 71, lateral end side 73, bottom side 79 of the machine body B, and with the lateral sides of the arm 95 and the lateral sides of the bed 90 in FIGS. 1 and 2. The display 98 of the indication device may be located at the position in the machine frame in FIG. 1 when the sewing machine is not used.

An operating part 7 is provided in the front side F of the machine body B, more precisely, in the front side 77 of the arm 95. The space 70 as defied by the lower end side 72 of the arm 95, the upper end side 91 of the bed 90 and the inner lateral end side 9 of the standard 96 is used as a stitch working place.

The display 98 of the indication device is provided on the front side F of the machine body B. The display 98 is located as normally occupying the parts of the arm 95 and of the standard 96. The display 98 is formed substantially in square and has a size that the lower part including the lower end side 59 partly protrudes into the space 70, that is, into the stitch working place when the display 98 is located as shown in FIG. 1.

The display 98 may be slidingly moved up and down on the front side F of the machine body B. The display 98 may be moved from the position of FIG. 1 up to the position where the lower end side 59 is substantially in alignment with the lower end side 72 of the arm 95 as shown in FIG. 2. Incidentally, the moving direction of the display 98 is not limited to the up and down direction only. The display 98 may be moved in the right and left direction or may be moved in the aslant direction, or may be moved freely up and down, right and left and aslant.

In FIG. 1, the display 98 is located at the lower most position where the upper end side 57 of the display 98 is located at the same level with the top side of the machine body 71 forming a continuous surface in a same plane and the front side 56 of the display 98 is located at the same level with the front side 77 of the arm 95 forming a continuous surface in a same plane.

Therefore, when the display 98 is located at the lower most position as shown in FIG. 1, the upper end side 57 and lateral end side 58 of the display 58 will not protrude from the top side 71 and lateral end side 73 and bottom side 79 of the machine body B respectively and from the lateral sides of the arm and bed 90. Namely the display 98 is compactly located in the machine frame of the machine body B. This position of the display 98 may be called a retreat position of the display 98.

In the retreat position, the display 98 is allowed to partly protrude into the stitch working space 70 because the sewing machine is left unused.

When the display 98 is in the upper position as shown in FIG. 2, the upper end side 57 of the display 58 is located above the top side 71 of the machine body B and the lower end side of the display 98 is located in alignment with the lower end side 72 of the arm 95 in a continuous surface in a same plane. In this condition, the inner lateral end side 9 of the standard 96 is not covered by the display 98. Namely the display 98 is moved away from the stitch working space 70. Thus the stitch working operation may be conducted with use of the whole stitch working space 70. This position of the display 98 provides a maximum stitch working space 70.

Further, when the display 98 is moved up as shown in FIG. 2, the display 98 comes to the position at the level of the machine operator's eyes for easy confirmation of the data indicated at the display. Further as the front surface of the standard 96 is uncovered, this area may be utilized to have operating buttons and the like arranged therein.

In FIG. 2, the front side 56 of the display 98 is continuous with the front side 77 of the arm 95 in the same plane and the lateral side 58 of the display 98 is continuous with the lateral end side 73 of the standard 96 in the same plane.

The display 98 may be moved up and down by operation of a switch 75 and may be stopped at an optional position that is most suitable for the level of the machine operator's eyes.

Figure 4:
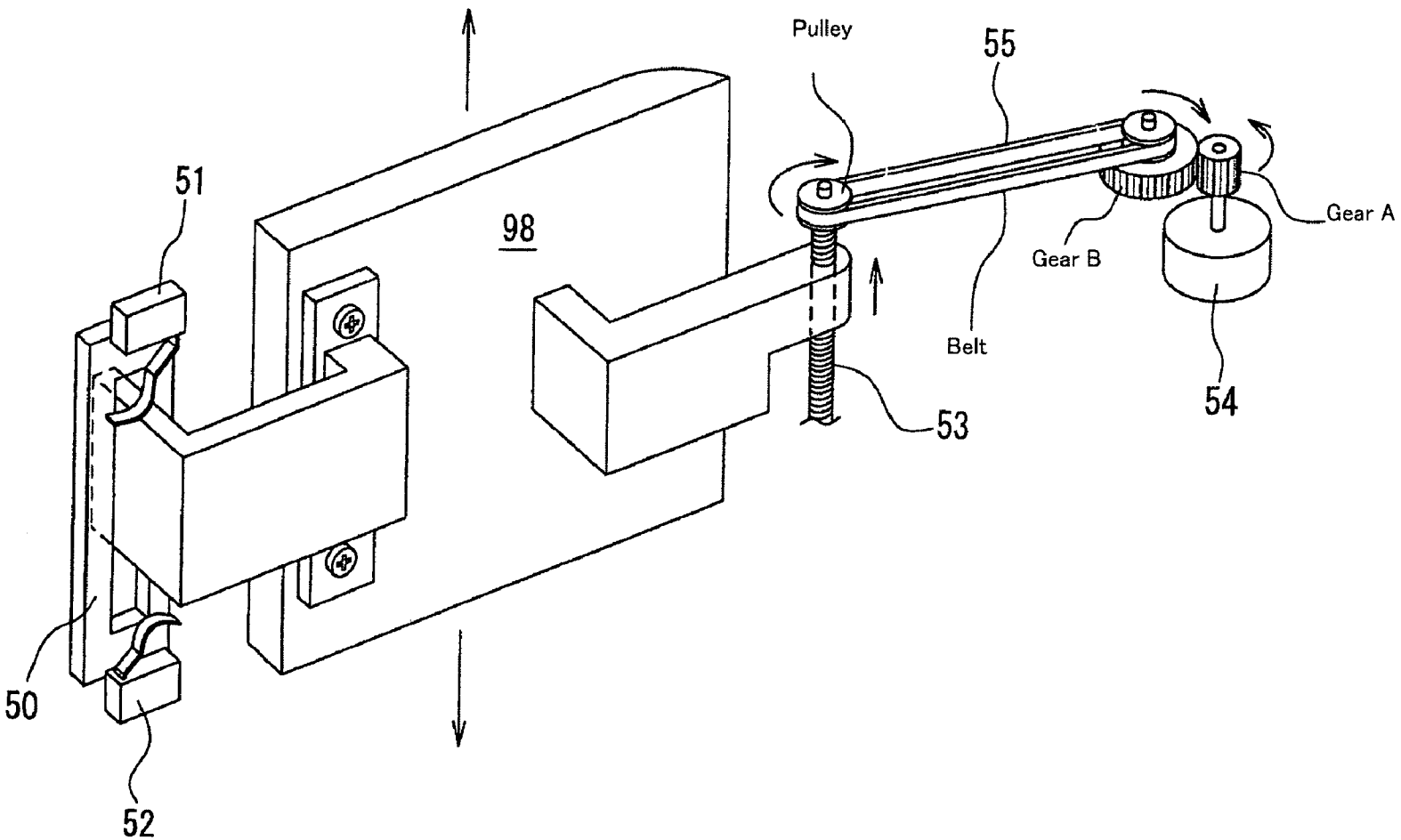
FIG. 4 is an explanatory view of a mechanism of the invention shown as one embodiment of the invention for moving the display.

FIG. 4 shows a mechanism for moving up and down the display 98.

The display 98 has one end side at the rear side thereof supported so as to be moved up and down as guided by a guide rail 50 and has the opposite end side connected to a feed screw 53 which is connected to a drive motor 54 through a transmission mechanism 55 so as to be rotated with rotation of the drive motor 54.

A microswitch 51 is provided at the upper end of the guide rail 50 and another microswitch 52 is provided at the lower end of the guide rail 50. The upper microswitch 51 is used to regulate the upper position of the display 98 and the lower microswitch 52 is used to regulate the lower position of the display 98 in FIG. 2.

Figure 5:
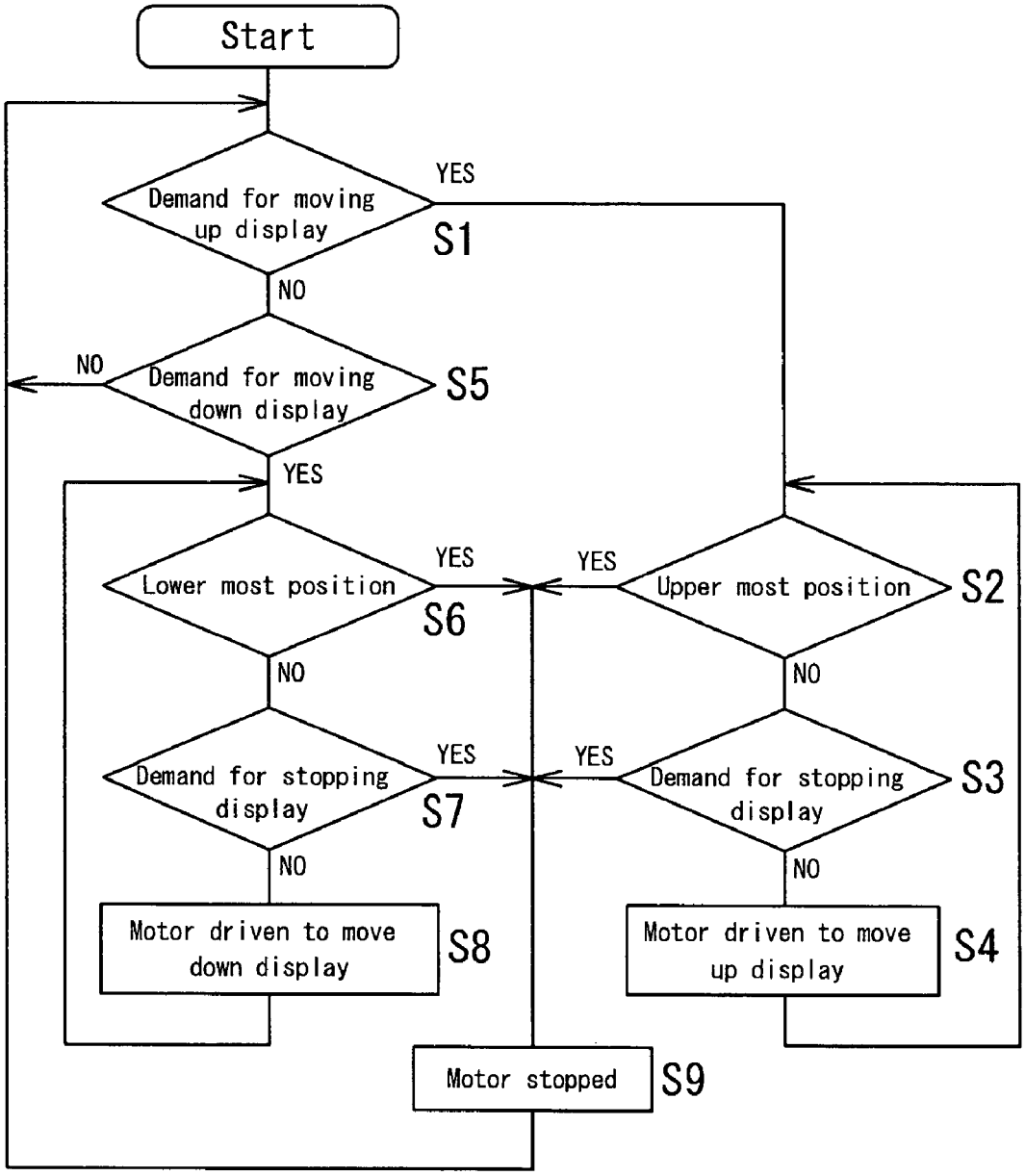
FIG. 5 is a flow chart showing a sequence of operations of the invention.

Now the operation of the invention will be described in reference to FIG. 5.

When the machine operator presses the switch 75 to give a signal for demanding the display 98 to move up (step S1), it is checked if a signal for detecting the microswitch 51 is present or not (step S2). Subsequently it is checked if the pressing operation of switch 75 is stopped or not (step S3) and then the drive motor 54 is driven (step S2) to move up the display 98. In case the microswitch detecting signal is present or the stop of pressing operation of switch 75 is detected, the drive motor 54 is stopped (step S9) to stop the movement of display 98 at the position.

Subsequently when the machine operator presses the switch 75 to give a signal for demanding the display 98 to move down (step S5), it is checked if a signal for detecting the microswitch 52 is present or not (step S6). Subsequently it is checked if the pressing operation of switch 75 is stopped or not (step S7) and then the drive motor 54 is driven (step S8) to move down the display 98. In case the microswitch detecting signal is present or the stop of pressing operation of switch 75 is detected, the drive motor 54 is stopped (step S9) to stop the movement of display 98 at the position.

Although it is described that the display 98 is moved up and down in this embodiment, it is possible that the display 98 my be moved, for example, aslant or in the right and left direction.

Further the display 98 may be simply superposed on the front side 71 or on the lateral end side 73 of the standard 96.

In such structure, the outer surface of the display 98 forms the outer surface of the machine body B defining the outline of the machine frame when the display 98 is located at the lower most position, that is, at the retreat position.

What is claimed is:

1. A sewing machine including a machine body having a top side, a lateral end side and a bottom side, said machine body being substantially composed of a bed, a standard standing up from the bed and an arm laterally extending from the standard substantially in parallel with the bed with a space provided between the upper end side of the bed and the arm, said sewing machine comprising; an indication means including a display movably arranged on said machine body, a mechanism for moving said display, said display being movable into a retreat area defined by said top side, said lateral end side and said bottom side of said machine body, and when said display is in said retreat area, part of said display protrudes in a space between said upper end side of said bed and said arm, said display being movable to a position for providing a maximum stitch working space between said upper end side of said bed and said arm where said display has no part protruding into said maximum stitch working space, and where part of said display protrudes from at least one of said top side or said lateral end side of the machine body.

2. The sewing machine as defined in claim 1, wherein said display is movable along the front side of said machine body.

3. The sewing machine as defined in claim 1, wherein said display may be stopped at an optional position.

4. The sewing machine as defined in claim 1, wherein said display has an upper end side forming a continuous surface with the top side of said machine body in a same plane and has a lateral end side forming a continuous surface with the lateral end side of said machine bodyin a same plane when the display is located in said retreat area.

5. The sewing machine as defined in claim 1, wherein said display has a lower end side forming a continuous surface with the lower end side of said arm in a same plane when the display is located at said position for providing a maximum stitch working space between the upper end side of said bed and said arm.

6. The sewing machine as defined in claim 1, wherein said display has a front side forming a continuous surface with the front side of said arm in a same plane.

* * * * *